US005607338A

United States Patent [19]

Landi

[11] Patent Number: 5,607,338

[45] Date of Patent: Mar. 4, 1997

[54] TOY WITH UNRAVELABLE CORD MATERIAL FOR SIMULATING HAIR OR FUR

[75] Inventor: Frank Landi, New Rochelle, N.Y.

[73] Assignee: Toymax Inc., Westbury, N.Y.

[21] Appl. No.: 506,845

[22] Filed: Jul. 25, 1995

[51] Int. Cl.[6] ..... A63H 3/44

[52] U.S. Cl. ..... 446/394; 446/296; 446/391; 132/53; 132/201

[58] Field of Search ..... 446/296, 319, 446/372, 394, 391; 434/94; 132/200, 201, 210, 53, 55, 56; 428/364

[56] References Cited

U.S. PATENT DOCUMENTS

| | | | |
|---|---|---|---|
| 1,627,511 | 5/1927 | Hopf . | |
| 2,152,085 | 3/1939 | Palmer . | |
| 2,177,426 | 10/1939 | De Journette | 446/394 |
| 2,393,064 | 1/1946 | Robinson | 132/53 |
| 2,538,157 | 1/1951 | Lewis | 446/394 |
| 3,116,954 | 1/1964 | Orenstein | 446/296 |
| 3,225,489 | 12/1965 | Ryan | 446/394 |
| 3,765,123 | 10/1973 | Terzian | 446/394 |
| 3,910,291 | 10/1975 | Kim | 132/53 |
| 4,070,790 | 1/1978 | Strongin et al. . | |
| 4,626,225 | 12/1986 | Katzman et al. . | |
| 4,874,676 | 10/1989 | Miller et al. . | |
| 5,129,853 | 7/1992 | Bowling . | |
| 5,299,968 | 4/1994 | Bennett . | |

*Primary Examiner*—Robert A. Hafer
*Assistant Examiner*—Jeffrey D. Carlson
*Attorney, Agent, or Firm*—Rosen, Dainow & Jacobs Limited Liability Partnership

[57] ABSTRACT

A toy figure is provided with lengths of flexible, unravelable cord material which simulates hair or fur. The cord material may be unraveled into individual strands or groups of strands which simulate strands of hair. The toy provides increased play value by permitting the child to unravel the cord material to produce strands of hair that may be cut, styled and washed.

14 Claims, 4 Drawing Sheets

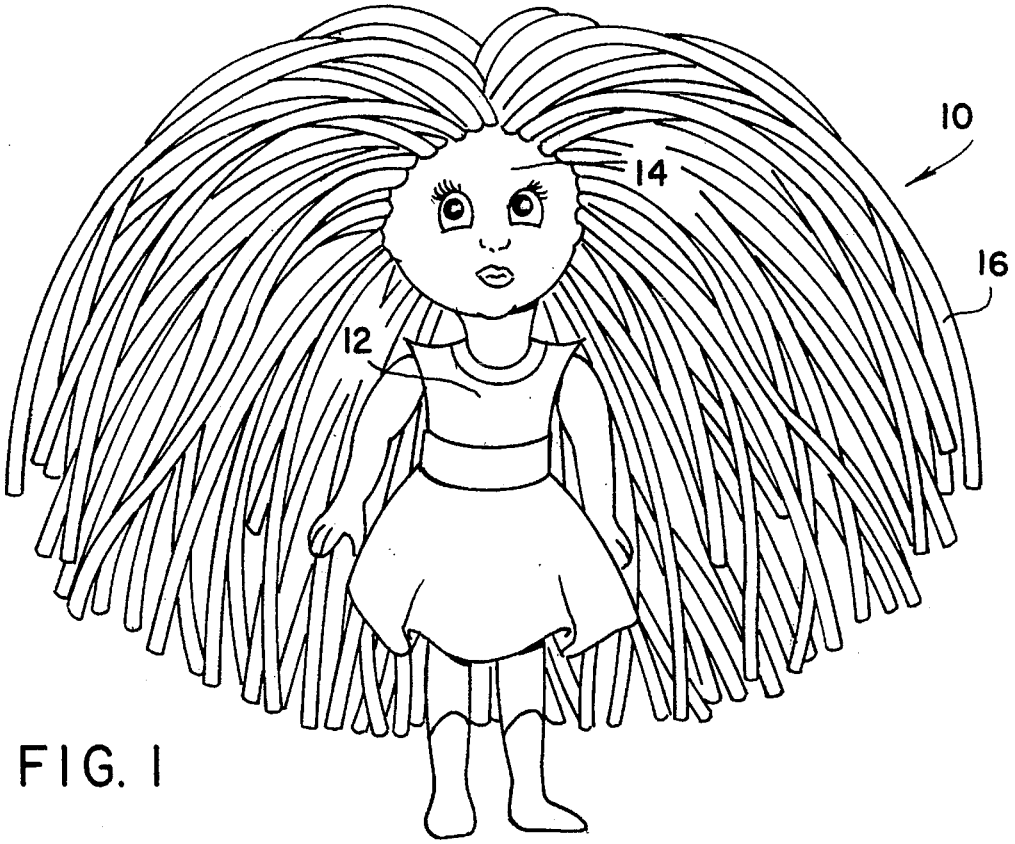
FIG. 1
FIG. 2
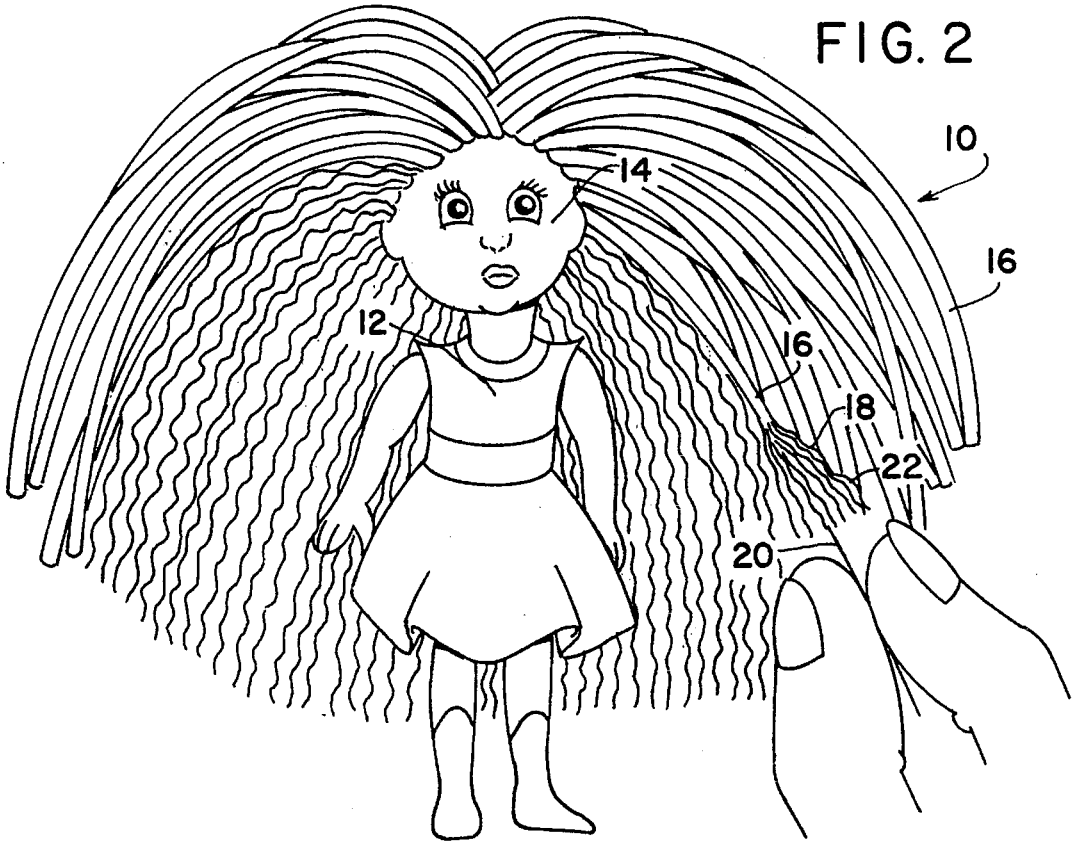

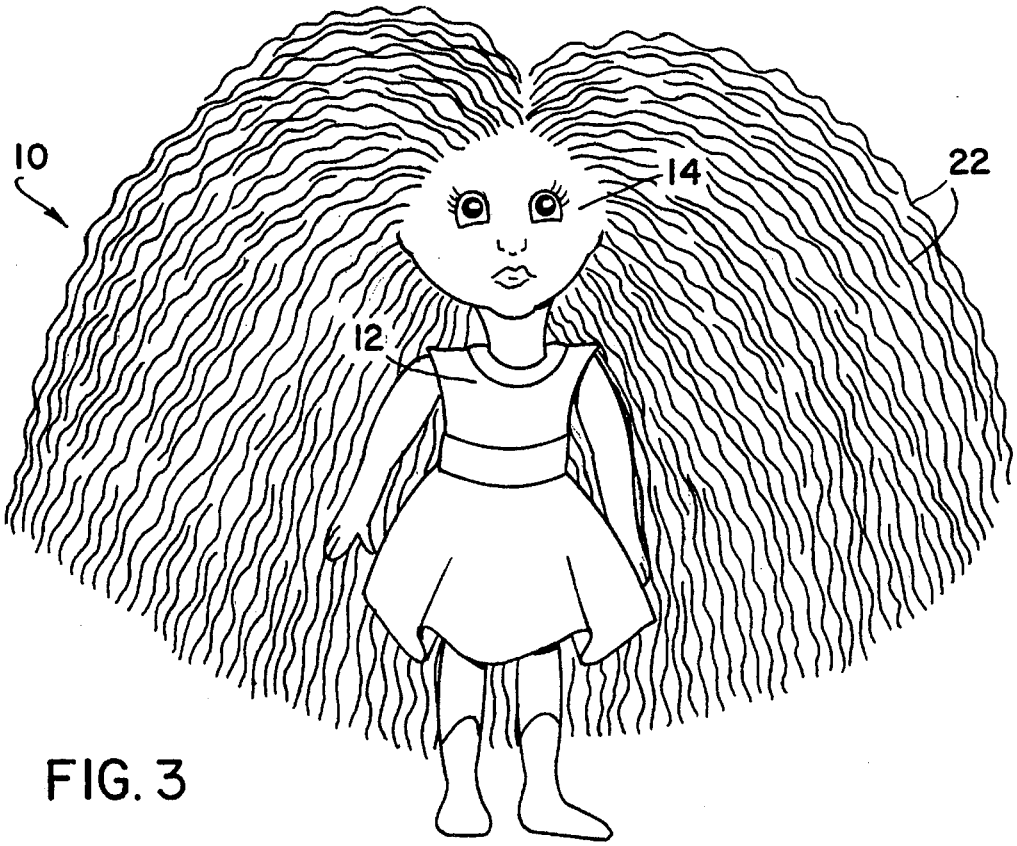
FIG. 3
FIG. 4
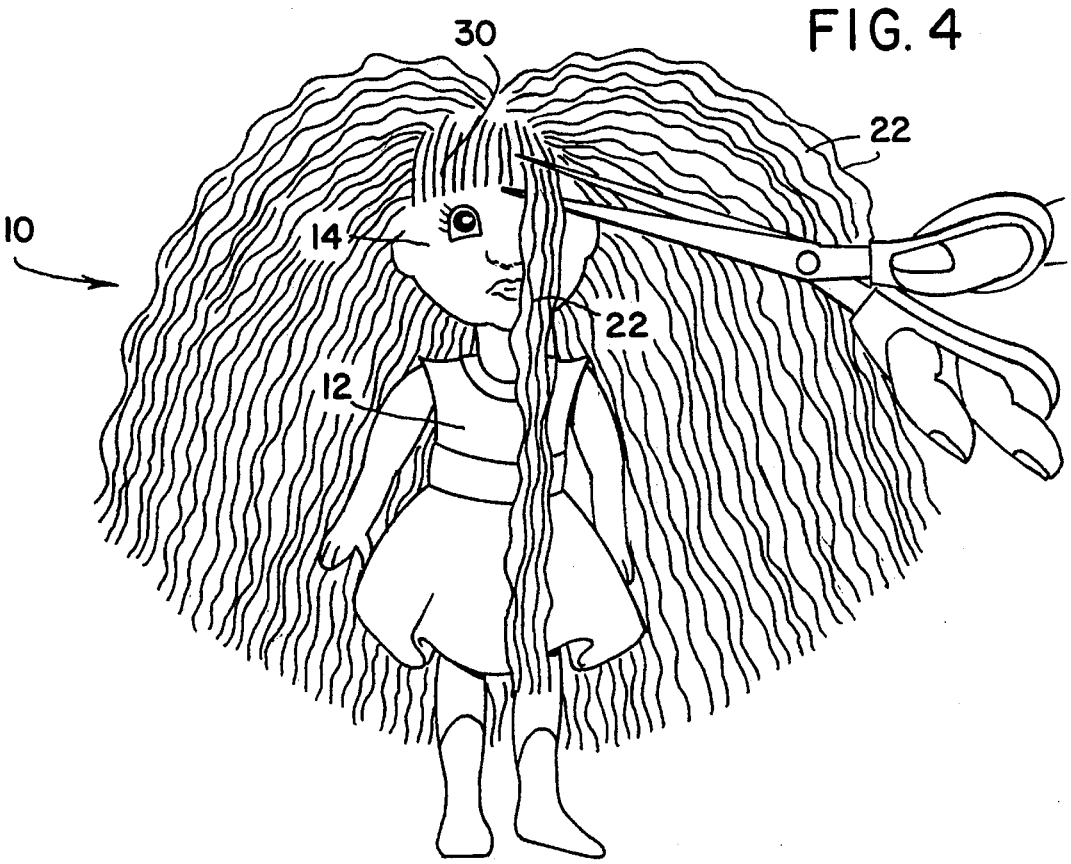

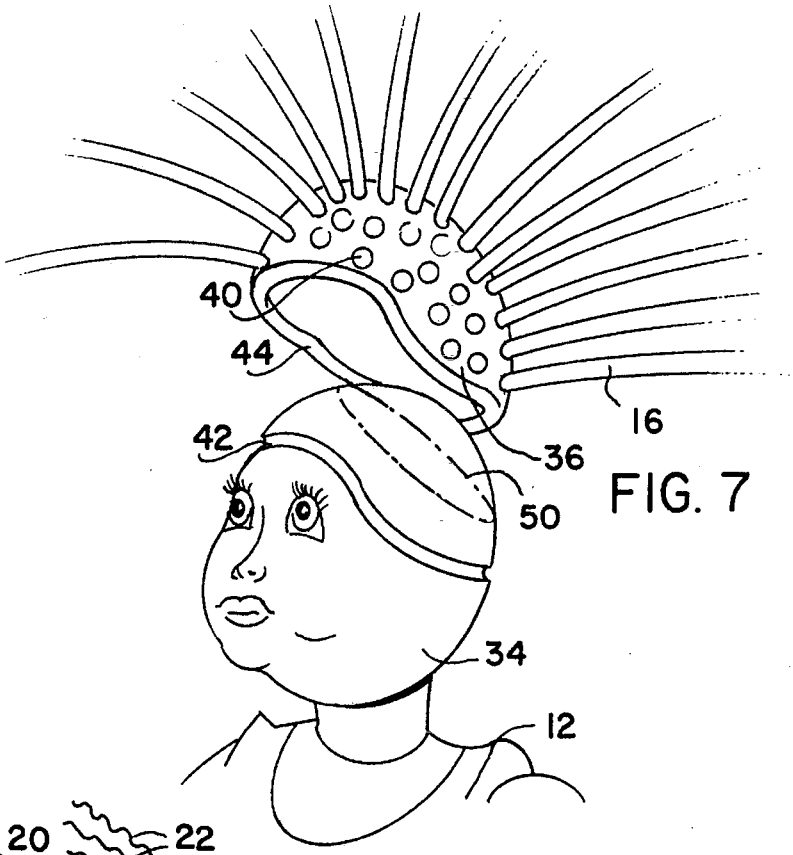
FIG. 7
FIG. 6
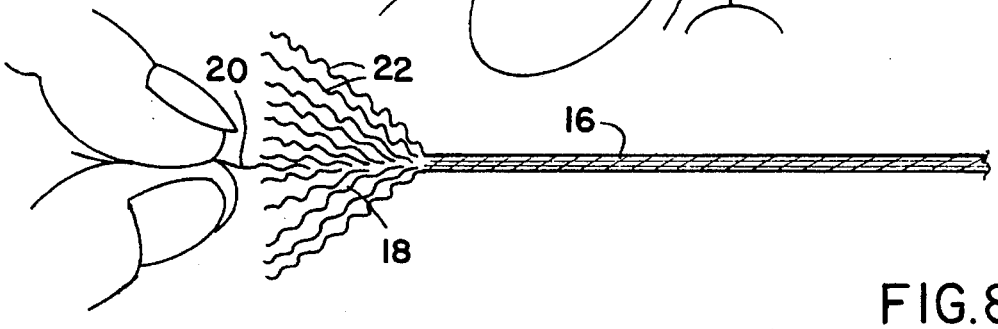
FIG. 8
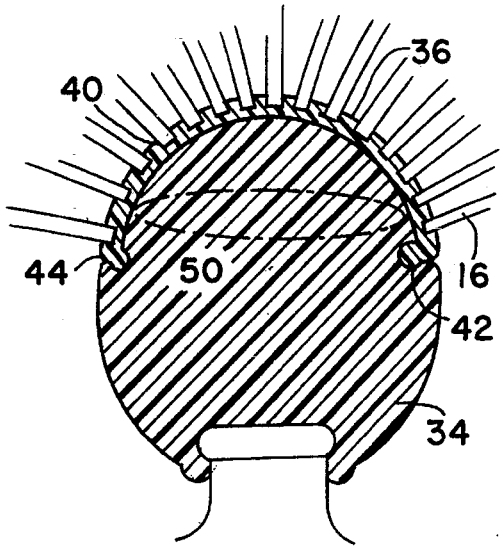
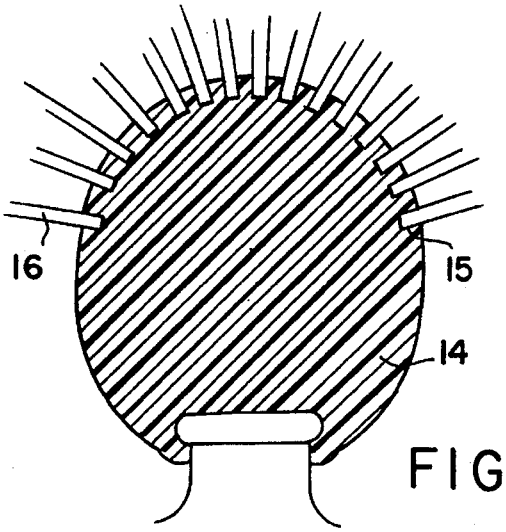
FIG. 5

TOY WITH UNRAVELABLE CORD MATERIAL FOR SIMULATING HAIR OR FUR

FIELD OF THE INVENTION

This invention relates to toy figures such as dolls including action figures, stuffed and plush toys, etc., representing humans, animals, creatures, robots etc., having flexible simulated hair or fur.

BACKGROUND OF THE INVENTION

Toy figures, both human and non-human, have been provided with strands of flexible material simulating hair or fur. The simulated hair and fur may be attached to the toy figure using many known fabrication techniques.

Bennett. U.S. Pat. No. 5,299,968 issued Apr. 5, 1994, discloses primary and secondary toy figures with interchangeable hair segments. A plurality of hair locks secured to the head of the primary or secondary toy figures may be interchanged and removed. Bowling, U.S. Pat. No. 5,129,853 issued Jul. 14, 1992, discloses a toy animal having a removable coat of long fur which can be cut and groomed to give a stylized appearance and then removed and replaced with another coat of fur. Strongin et al., U.S. Pat. No. 4,070,790 issued Jan. 31, 1978, discloses a doll adapted to receive interchangeable hair pieces of different hair coloring or styling. Palmer, U.S. Pat. No. 2,152,085 issued Mar. 28, 1939, discloses a coiffure for a plastic figure such as a girl's head wearing a cap with a plurality of spaced radial openings provided in the head adjacent the meeting line of the head with the cap in which curl sets are inserted. Hopf, U.S. Pat. No. 1,627,511 issued May 3, 1927, discloses a doll head with tufts representing plaited hair projected through openings in the head. The tufts are ornamented with a bow and are spaced apart and located around the head, and give the doll the appearance of a child with braids.

Though the above-described toys have simulated hair or fur which provide children with amusement, there is a continuing need for toys in which simulated hair or fur provides increased play value to amuse and delight children and to satisfy their play requirements.

SUMMARY OF THE INVENTION

It is an object of the invention to provide a toy with simulated hair or fur with improved play value.

It is a further object of the invention to provide a toy with attractive and stylish simulated hair or fur.

It is another object of the invention to provide a toy where the child may convert the simulated hair or fur of the toy from one type to another.

It is still a further object of the invention to provide a toy where the child can style the simulated hair or fur of the toy.

It is still another object of the invention to provide a toy where the child may cut and style the simulated hair or fur of the toy.

It is an additional object of the invention to provide a toy where the simulated hair or fur of the toy may optionally be replaced.

These and other objects of the invention are accomplished by providing a toy figure having simulated hair or fur at least some of which is provided in a corded, but unravelable state. According to the invention, simulated hair is provided by an unravelable cord material. By "cord material" it is meant that strands or fibers making up the cord material are provided in a bundled or woven or stitched, etc., state or condition which may be unraveled to provide the individual strands or fibers or groups of strands or fibers. In the description below and in the claims, the word "hair" includes fur and like things, unless the context indicates otherwise, and the individual strands or fibers of the cord material are referred to as strands. Also, in the description below and in the claims "unraveled" and "unravelling" mean disassembly of the cord material to individual strands and/or groups of strands, unless the context indicates otherwise.

According to the invention, the toy figure is provided with all or some of its hair in the corded state, which the child may unravel while playing with the toy figure. The corded simulated hair is made of unravelable lengths of cord material, each length of which when unraveled produces a plug of simulated hair comprising numerous groups of strands and/or individual strands.

In the preferred embodiment, each length of cord material unravels into groups of individual strands and/or individual strands. The individual strands and the groups of strands have many small waves or kinks therein to present a crimped hair style. In the preferred embodiment, the cord material is simply a length of cord which comprises a core strand that weaves together several groups of strands. The groups of strands may in a particular cord be formed by sub-groups of individual strands.

The invention provides a toy with simulated hair that children can cut and style. However, the invention provides more in that the children must first unravel lengths of cord material before individual strands of simulated hair appear. In the case of a female doll, before unraveling, the hanging cords present a hair style which in a way resembles the one made famous in the film Ten, starring Bo Derek, where all of the hair hangs in long, tightly braided lengths referred to as corn braids or corn rows. With a toy figure or doll incorporating the invention, the act of unraveling the lengths of cord material, the marked change in the appearance of the toy figure before and after unraveling, the crimped style of one embodiment, the ability to cut, wash and style the simulated hair, all provide increased play value.

In the preferred embodiment, once unraveled, the strands cannot be re-corded. In one embodiment, the lengths of cord material are replaceable. Therefore, with replaceable cord material, the toy figure can be used anew. One way of providing replaceable cord material is to provide the toy figure with a removable hair piece or wig (or coat of fur, etc.). For example, a removable skull cap of simulated hair may be provided. When the child wishes to start afresh, he or she may replace the skull cap in which the cord material has been unraveled, and cut or styled, etc. with a new skull cap, including lengths of cord material simulating hair. Replacement of the skull cap assures prolonged interactive play with the same toy. The cord material may also be replaced cord by cord, or group by group.

The invention encompasses: toy figures with the unravelable corded simulated hair, including a toy figure with all corded hair, some corded and some unraveled hair and all unraveled hair; the unravelable corded simulated hair itself in a corded and/or unraveled state; and the method of styling or playing with the unravelable simulated hair.

In a further embodiment of the invention a method of making hair for a toy figure comprises securing lengths of unravelable cord material to the toy figure and then unraveling the cord material.

The above and other objects, aspects, features and advantages of the invention will be more readily apparent from the description of the preferred embodiment taken in conjunction with the accompanying drawings and appended claims.

BRIEF DESCRIPTION OF THE DRAWINGS

The invention is illustrated by way of example and not limitation in the figures of the accompanying drawings in which like references denote like or corresponding parts, and in which:

FIG. 1 is a front view of a toy doll according to the invention having lengths of unravelable cord material simulating hair, none of which is unraveled;

FIG. 2 is a front view of the toy doll of FIG. 1 according to the invention with some of the lengths of the unravelable cord material unraveled, showing one length being unraveled;

FIG. 3 is a front view of the toy doll of FIG. 1 with all of the lengths of unravelable cord material unraveled and presenting a crimped hair style;

FIG. 4 is a front view of the toy doll of FIG. 1 showing some of the unraveled strands being cut;

FIG. 5 is a vertical cross-sectional view of the head of the toy doll of FIG. 1;

FIG. 6 is a diagram of a length of unravelable cord material secured at one end and (not shown) being unraveled at the other end in accordance with the invention;

FIG. 7 is a front exploded view of a toy doll according to the invention with a removable skull cap having the unravelable cord material attached thereto;

FIG. 8 is a vertical cross-sectional view of the head of the toy doll of FIG. 7 with the removable skull cap secured to the head;

DESCRIPTION OF THE PREFERRED EMBODIMENT

Figure 9:
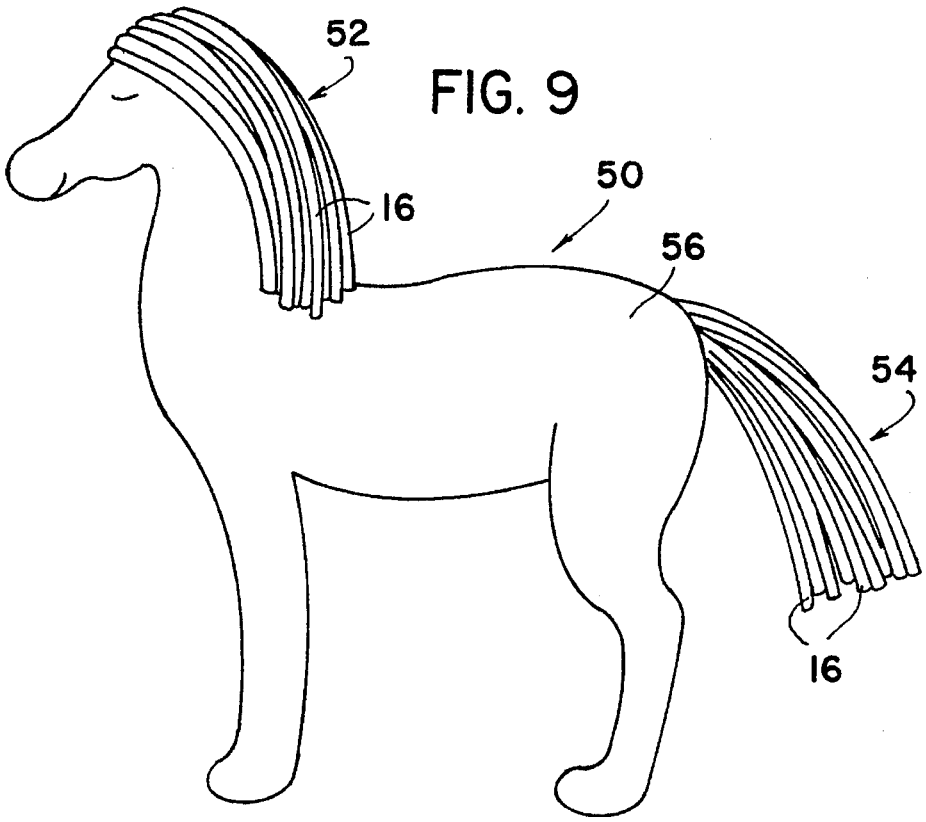
FIG. 9 is a side view of a toy stuffed horse with lengths of the unravelable cord material according to the invention representing the horse's mane and tail.

Referring to FIGS. 1 and 2, a toy doll 10 having a body 12 and a head 14 is provided with a plurality of lengths of unravelable cord material 16 emanating from the head to simulate hair. In the preferred embodiment, the unravelable cord material is simply an unravelable length of cord, and will be referred to below as "cord". The doll may be made of porcelain, or plastic which is rigid or flexible. The doll may be made of hard plastic such as polystyrene or polyethylene or a relatively softer material such as vinyl. The doll may be stuffed and covered with fabric or plush. Preferably the head 14 of the doll is made of a flexible plastic such as vinyl.

The cords 16 are attached to the head 14 in any suitable manner to hang therefrom, as discussed in more detail below. Each length of cord 16 is unravelable to produce a plug of hair 18 comprising numerous individual strands or fibers 22 as shown in FIGS. 2 and 6. With the particular cord described below used in the preferred embodiment, the unraveled strands 22 have small waves or kinks, and present a crimped hair style.

As shown in FIGS. 2 and 6, the cords 16 each comprise a center strand or core strand 20, made of one or several strands or fibers, which may be pulled to unravel the cord. The unravelable cord 16 employed in the invention is a tubular rattail cord imported from Taiwan made of nylon fibers or stands 22 with a synthetic center fiber or strand 20 and may be purchased as Item No. 11736 from Jay Company, 22 West 38th Street, New York, N.Y. 10018. This imported rattail cord from Taiwan is produced by a speed needle machine and unravels in one direction only, i.e., pulling the center strand from one end of a length of the cord will unravel it, while pulling from the opposite end will not. Accordingly, the ends of the lengths of cord 16 which do not unravel when the center strand 20 is pulled are secured in the openings 15 in the doll's head 14. The other ends of the lengths of cord 16 which unravel when the center strand 20 is pulled are left hanging free.

The individual strands or fibers 22 of the cord 16 are arranged in groups which are woven together by a binding chain stitch with the center core strand 20. When the core strand 20 is pulled, it unlocks the binding stitch so that the unravelable cord 16 unravels into the groups, each of which may then optionally be separated into numerous individual strands or fibers 22 by working the groups, for example, between one's first finger and thumb. All or a number of the lengths of cord 16 may be unraveled to style the hair of the doll 10, as shown in FIGS. 2 and 3, and some of the lengths of cord 16 may be only partially unraveled, as shown in FIG. 2.

As shown in FIG. 3, with all of the lengths of cord 16 unraveled, a full and fluffy head of hair made of a multiplicity of individual fibers 22 is provided. The lengths of cord 16 may be unraveled by a child after manufacture and purchase to add interactive play value. Additionally, as shown in FIG. 4, the simulated hair made of flexible fiber material may be cut, e.g., to make bangs 30, and styled before or after unraveling the cords.

The simulated hair provided by the invention adds a play value dimension heretofore not provided for toys with simulated hair, and that is the unraveling of some or all of the cords, or partial unraveling of some or all of the cords, prior to styling, cutting, etc. Therefore, the toy provides not only the play value associated with cutting, styling, washing, etc., the simulated hair, but also unraveling it, entirely or partially.

Additionally, the lengths of cord 16 may be washed before or after unraveling to increase play value. Accordingly, the invention provides a toy that is ideal for children who like to create a full head of hair, and cut, style and wash the hair. The simulated hair produced by the unraveling of unravelable cord is full and fluffy and aesthetically attractive, and when using the imported Taiwanese cord described above, presents a crimped style. The small waves are caused by compressing of the fibers by the center strand when bound. The individual cords may be of different color to give a head of hair with a rainbow of colors and the cords may be of different length. This applies to the embodiments described below as well.

Though the invention in its preferred embodiment employs the unravelable cord as described above, any type of unravelable cord such as cord which unravels from both ends when a strand is pulled, or cord made of different material such as corded silk, tubular satin ribbon, or cord made of bundles of rayon or polyester woven together by a cotton core strand, may be employed instead, as long as the cord may be unraveled into individual strands which resemble hair or fur.

The cords 16 may be attached to the doll's head 14 in any suitable manner. For example, the head of the doll 14 may be provided with holes therethrough as shown in FIG. 5 in which a respective length of unravelable cord is affixed. The lengths of unravelable cord may be secured in the holes by an adhesive such as glue or by bayoneting. A bayonet is made of a conical section with a tubular section extending from the flat side of the conical section but of a smaller diameter. The cord is secured in the tubular section and the bayonet is pushed through the holes in the doll's head. An edge of the flat side of the conical section around the tubular section prevents the bayonet from coming out of the doll's head. Alternatively, the unravelable cords may be secured in the holes in the case of synthetic fibers by melting the ends of the cords into the holes or into runners extending along the hair line. Additionally, the ends of the cords can be mechanically fastened in the holes such as by knotting.

The simulated hair according to the invention may be permanent or alternatively removably attached to the figure to provide still more play value, and enable a child to replace individual unraveled cords or the entire set of cords.

FIG. 7 shows an embodiment of the invention in which the entire set of cords is removable. The doll includes a head 34 which removably receives a skull cap 36. The skull cap 36 has holes 40 therein, and an unravelable cord 16 is secured in each hole 40. The doll's head 34 has a groove 42 therein into which the edge 44 of the skull cap 36 removably snaps. The groove 42 is shown along the hair line of the doll in FIG. 7. As illustrated in FIGS. 7 and 8, the head 34 is a full head, but the head may be made with an opening 50 as shown schematically by the dotted lines so that the head 34 is only a partial head. Snapping the skull cap 36 onto the partial head 34 forms the complete head with hair. Other ways of attaching replaceable cords may be employed.

In the embodiment of the toy doll shown in FIGS. 7 and 8, the lengths of cord 16 may be unraveled or partially unraveled by the child after manufacture and purchase; the hair may be cut, styled and washed; and the skull cap 36 may be removed and replaced with a new skull cap so that the child may unravel the lengths of cord 16, and start a new and different style. Each skull cap may have different colors of hair. Thus, the same toy can be groomed to give different appearances to the toy. Increased play value is established by the different acts of: unraveling the lengths of unravelable cords, cutting, styling, washing the hair, and replacing the skull cap to repeat the process. Thus, the toy of the invention has high play value.

Figure 10:
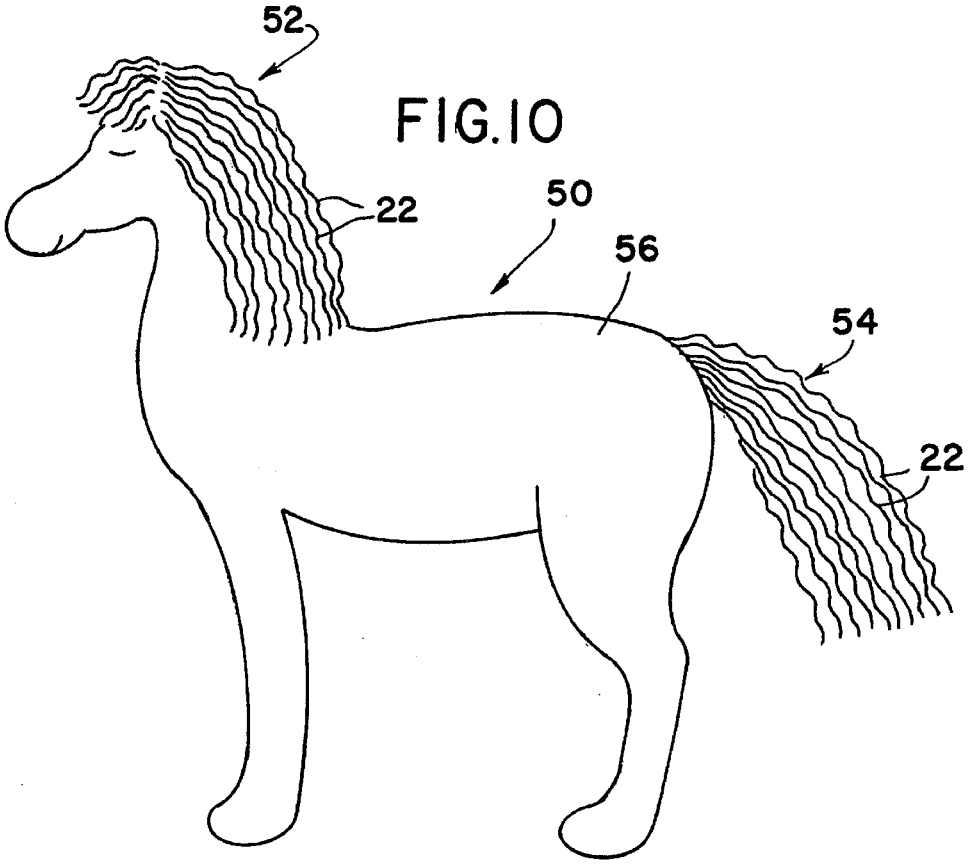
FIG. 10 is a side view of the toy stuffed animal of FIG. 9 with all of the lengths of cord material unraveled.

The toy according to the invention may be an animal (e.g., horse) shape as shown in FIGS. 9 and 10. Certain parts of the toy animal may be represented by unravelable cord according to the invention, e.g., for a horse 50, its mane 52 and/or tail 54. The body 56 of the toy horse 50 may be covered with a plush fabric having short pile, for example, ¾ inch, which is too short for cutting and styling. Alternatively, the toy horse may be made of any other type of fabric or of plastic as described above with respect to the doll. The lengths of unravelable cord 16 form the mane 52 and tail 54 of the horse. As with the doll, the lengths of unravelable cord 16 may be unraveled fully (FIG. 10) or partially before or after manufacture and purchase to form individual strands 22 as described above, and may be cut, styled, etc., as described above. The lengths of unravelable cord 16 may be secured as described above for doll 10. For a stuffed toy, whether a rag doll or stuffed animal, the lengths of cord 16 may be secured by sewing. For example, a seam along the neck of the horse may be sewn with the lengths of cord 16 therein. For a rag doll, the seam along the shape of the head may secure the lengths of cord 16. Alternatively, the cords 16 may be fused to intermediate structures which are sewn into the toy. This method of securing cords 16 to a toy horse may be employed for a stuffed doll also. Also, the lengths of cord 16 may be secured to a plush or fabric covered toy using the bayonet technique described above or a fastener that is inserted through the fabric and spread open.

The toy of the invention may further include a tool for unraveling the cords 16. Additionally, accessories may be provided such as a barrette for the child to wear which has unravelable cord according to the invention affixed to it as a decoration.

The simulated hair in a corded and/or unraveled state may be used for a wig for a doll, or human child or adult. Any conventional wig making technique may be employed to produce a wig from the cord material according to the invention, e.g., the cords may be stitched or glued to a net, fabric or vinyl cap, etc. For example, the shape of the skull cap 36 may be modified to resemble a wig, and the base material may be made in accordance with conventional wig making techniques to fit and remain on the head of the wearer during normal usage. A play or costume wig made of the simulated hair of the invention is ideal for a Halloween, clown, or masquerade costume. Multiple colors may be provided for a single play wig to provide a rainbow effect.

Although the invention has been described with reference to the preferred embodiments, it will be apparent to one skilled in the art that variations and modifications are contemplated within the spirit and scope of the invention. The drawings and description of the preferred embodiments are made by way of example rather than to limit the scope of the invention, and it is intended to cover within the spirit and scope of the invention all such changes and modifications.

I claim:

1. A toy figure having simulated hair comprising as the simulated hair at least one length of an unravelable cord material having a corded state and an unraveled state, said at least one length of unravelable cord material having a longitudinal axis and comprising a plurality of first strands and a second strand which in said corded state of said cord material extends along said at least one length of cord material so as to hold said first strands in said corded state and when pulled along a generally non-rotating direction with respect to said longitudinal axis, said second strand unravels said at least one length of cord material into said unraveled state, said second strand continuing to unravel said cord length as long as said second strand is pulled.

2. The toy figure according to claim 1, wherein said toy figure is a doll.

3. The toy figure according to claim 1, wherein said toy figure is stuffed.

4. The toy figure according to claim 1, wherein said toy figure is covered at least partially by cloth or fabric.

5. The toy figure according to claim 1, wherein said toy figure is plush.

6. The toy figure according to claim 1, comprising a plurality of lengths of said unravelable cord material, each being unravelable into said unraveled state to produce plugs of simulated hair each having a plurality of first strands.

7. The toy figure according to claim 6, wherein said first strands are wavy.

8. The toy figure according to claim 1, wherein said cord material is partially and fully unravelable to provide said unraveled state of said cord material.

9. The toy figure according to claim 1, wherein said first strands may be cut and styled.

10. The toy figure according to claim 1, wherein said at least one length of cord material is removably attached to said figure and comprising at least one other length of cord material removably attachable to said toy figure.

11. The toy figure according to claim 1, wherein the toy is a doll having a head and further including a skull cap to which said at least one length of cord material is secured, said skull cap being removable and replaceable on said doll's head.

12. The toy according to claim 1, wherein said unravelable cord material is rattail cord.

13. The toy figure according to claim 1 comprising means for non-removably attaching said at least one length of cord material to said toy figure.

14. The toy figure according to claim 1 comprising means for removably attaching said at least one length of cord material to said toy figure.

* * * * *